US010752024B2

(12) United States Patent
Robustelli et al.

(10) Patent No.: US 10,752,024 B2
(45) Date of Patent: Aug. 25, 2020

(54) INKJET PRINTER AND METHOD FOR SEPARATING INKJET PRINTER

(71) Applicant: SEIKO EPSON CORPORATION, Tokyo (JP)

(72) Inventors: Sandro Robustelli, Villa Guardia (IT); Rodolfo Cazzaniga, Cassago Brianza (IT)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/456,296

(22) Filed: Jun. 28, 2019

(65) Prior Publication Data

US 2020/0001625 A1 Jan. 2, 2020

(30) Foreign Application Priority Data

Jun. 28, 2018 (JP) ..... 2018-122977

(51) Int. Cl.
*B41J 11/00* (2006.01)
*B41J 29/02* (2006.01)

(52) U.S. Cl.
CPC ..... *B41J 11/007* (2013.01); *B41J 29/02* (2013.01)

(58) Field of Classification Search
CPC ..... B41J 11/007; B41J 29/02; B41J 3/4078; B41J 2/17509; B41J 29/38; B41J 29/026
See application file for complete search history.

(56) References Cited

U.S. PATENT DOCUMENTS 6,068,374 A * 5/2000 Kurata ..... B41J 3/4078 347/100
2001/0022903 A1 9/2001 Shirasawa et al.
2007/0009310 A1 1/2007 Kato

FOREIGN PATENT DOCUMENTS

DE 69529004 7/2003
JP 2017-132192 A 8/2017

* cited by examiner

*Primary Examiner* — Huan H Tran
(74) *Attorney, Agent, or Firm* — Workman Nydegger

(57) ABSTRACT

A printer includes a main frame, a first roller, a second roller, and a transport belt wound around the first roller and the second roller and transporting a medium by rotating while supporting the medium, and a printing unit that performs printing on the medium. The main frame is configured of a plurality of blocks that are separably connected with one another in the transport direction. At least one of the first roller and the second roller is defined as a roller to be consolidated, the first roller, the second roller, and the transport belt are configured to be consolidated in a consolidation block, which is a block for consolidation, by moving the roller to be consolidated from a deployment block, which is a block where the roller to be consolidated is fixed when the medium is transported, to the consolidation block.

8 Claims, 12 Drawing Sheets

INKJET PRINTER AND METHOD FOR SEPARATING INKJET PRINTER

The present application is based on and claims priority from JP Application Serial Number 2018-122977, filed Jun. 28, 2018, the disclosure of which is hereby incorporated by reference herein in its entirety.

BACKGROUND

1. Technical Field

The present disclosure relates to an inkjet printer and a method for separating the inkjet printer.

2. Related Art

In related art, inkjet printers are known that perform printing of images, characters and the like on a medium, by moving the medium, which is paper, fabric or the like, with respect to a head that discharges ink. Some of these inkjet printers include a transport device that supports a medium by an endless transport belt and transports the medium in a transport direction. For example, JP 2017-132192 A discloses an inkjet recording device as an inkjet printer that includes an endless transport belt wound around two rollers, which are a driving roller fixed to a support frame and a driven roller.

The inkjet printer described in JP 2017-132192 A is mainly used in industrial applications. Inkjet printers used in industrial applications have a tendency to increase the range of printing in the transport direction to improve production capacity, and the transport device provided in the inkjet printer tends to be extended. Moreover, with the transport device provided with the transport belt, it is difficult to remove the transport belt from the two rollers (a first roller and a second roller) that are attached to both ends of a main frame, and the main frame cannot be easily separated. As a result, for example, there is a problem in that the inkjet printer cannot be stored in a container of a prescribed size, and shipping to move and install the inkjet printer is impaired. Therefore, there is a demand for an inkjet printer that can easily separate the main frame into a plurality of blocks without removing the transport belt.

SUMMARY

An inkjet printer according to the present application includes a main frame, a first roller attached to the main frame, a second roller attached to the main frame, a transport belt wound around the first roller and the second roller and configured to transport a medium in a transport direction by rotating while supporting the medium, and a printing unit configured to perform printing on the medium supported on the transport belt. The main frame is configured of a plurality of blocks that are separably connected with one another in the transport direction, and at least one of the first roller and the second roller is defined as a roller to be consolidated. The first roller, the second roller, and the transport belt are configured to be consolidated in a consolidation block, which is a block for consolidation, by moving the roller to be consolidated from a deployment block, which is a block where the roller to be consolidated is fixed when the medium is transported, to the consolidation block.

In the above-described inkjet printer, in the main frame, a rail portion may be provided in each of the blocks included in a moving range of the roller to be consolidated, and the first roller, the second roller, and the transport belt may be configured to be consolidated in the consolidation block by moving the roller to be consolidated along the rail portion.

In the above-described inkjet printer, the deployment block may be provided with a first fixing portion for fixing the roller to be consolidated when the medium is transported, and the consolidation block may be provided with a second fixing portion for fixing the roller to be consolidated when the first roller, the second roller, and the transport belt are consolidated in the consolidation block.

In the above-described inkjet printer, a length of each of the plurality of blocks may be configured to be not greater than 2352 mm in the transport direction.

In the above-described inkjet printer, the plurality of blocks may include a first block as the deployment block, a second block as the deployment block, and a third block as the consolidation block, the first block may be positioned upstream of the third block in the transport direction when the first block is connected with the third block, and the second block may be positioned downstream of the third block in the transport direction when the second block is connected with the third block. The first roller may be configured to be fixed in the first block, and the second roller may be configured to be fixed in the second block when the medium is transported by the transport belt, and the first roller, the second roller, and the transport belt may be configured to be consolidated in the third block by moving the first roller from the first block to the third block and moving the second roller from the second block to the third block.

The above-described inkjet printer may include a medium support unit provided at an inside of the transport belt and in a region between the first roller and the second roller, and configured to support the medium via the transport belt. The printing unit and the medium support unit may be attached in the third block, and the medium support unit may be configured to change a deployment range in the transport direction in the third block.

The above-described inkjet printer may includes a pressing unit provided in the first block and configured to press the medium toward the transport belt, and a pressing unit-support unit provided at an inside of the transport belt and in a region between the first roller and the second roller, and configured to support the pressing unit via the transport belt. The pressing unit-support unit may be configured to move at least between the first block and the third block.

A method for separating an inkjet printer according to the present application is a method for separating an inkjet printer including a main frame, a first roller attached to the main frame, a second roller attached to the main frame, a transport belt wound around the first roller and the second roller and configured to transport the medium in a transport direction by rotating while supporting the medium, and a printing unit configured to perform printing on the medium supported on the transport belt, the main frame being configured of a plurality of blocks that are separably connected with one another in the transport direction, and the first roller and the second roller being fixed to the blocks that are different from each other when the medium is is transported by the transport belt. The method includes, defining at least one of the first roller and the second roller as a roller to be consolidated, consolidating the first roller, the second roller, and the transport belt in a consolidation block, which is a block for consolidation, by moving the roller to be consolidated from a deployment block, which is a block where the roller to be consolidated is fixed when the medium is transported, to the consolidation block, and separating the main frame at least into a part including the consolidation block and a part including the deployment block.

DESCRIPTION OF EXEMPLARY EMBODIMENTS

Exemplary embodiments of the present disclosure will be described below with reference to the accompanying drawings. Note that, in each of the figures below, to illustrate each of layers or each of members at a recognizable size, a scale of each of the layers or each of the members is different from an actual scale.

FIGS. 1 to 7 and FIGS. 9 to 13 illustrate an X axis, a Y axis, and a Z axis as three axes orthogonal to one another for the convenience of explanation, where the tip end side of an arrow indicating the axial direction is defined as a "positive (+) side" and the base end side as a "negative (−) side". Herein, a direction parallel to the X axis is referred to as an "X axis direction", a direction parallel to the Y axis as a "Y axis direction", and a direction parallel to the Z axis as a "Z axis direction".

Exemplary Embodiment

Schematic Configuration of Inkjet Printer

Figure 1:
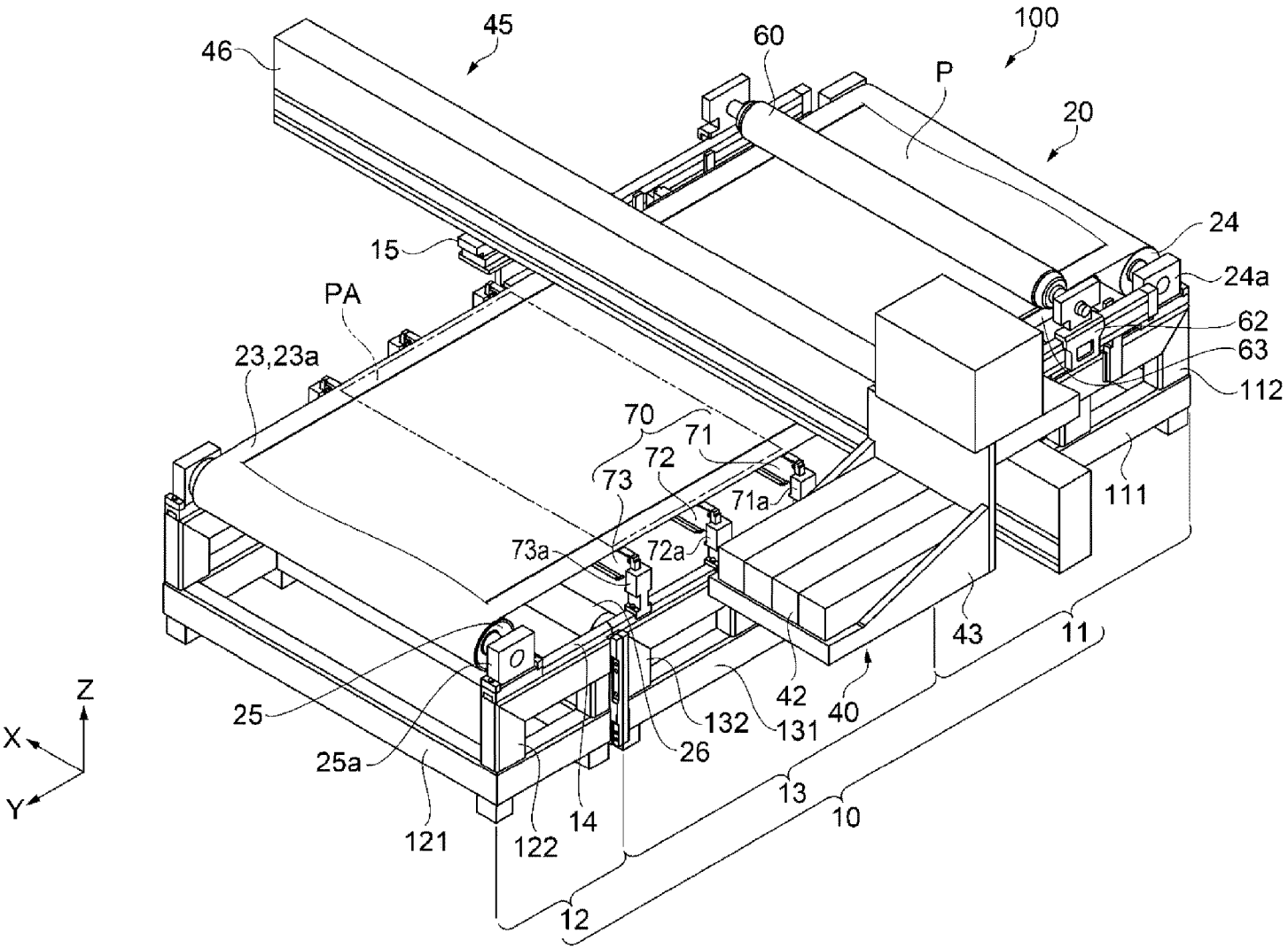
FIG. 1 is a perspective view illustrating an overall configuration of an inkjet printer according to an exemplary embodiment.
Figure 2:
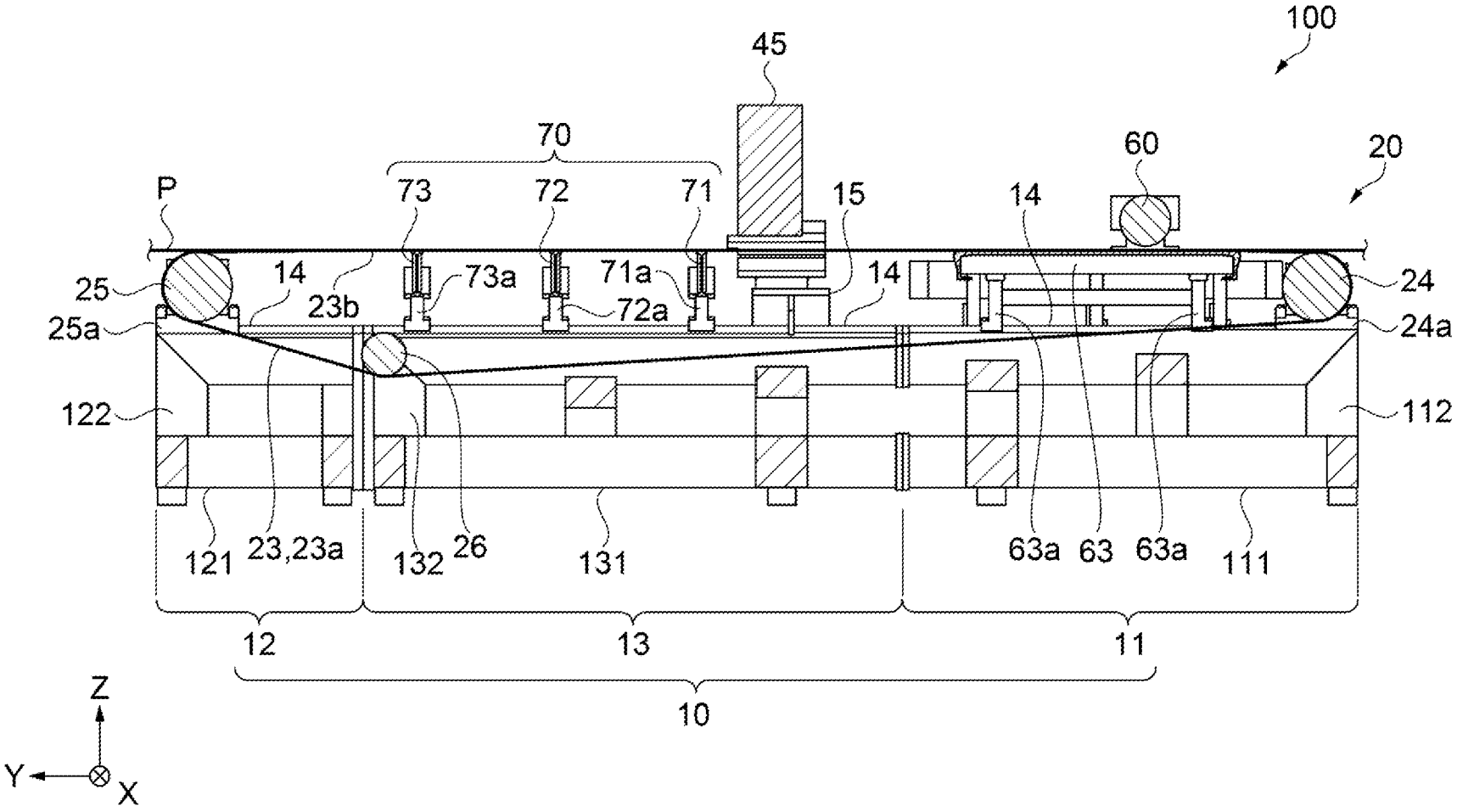
FIG. 2 is a side cross-sectional view of the inkjet printer.

FIG. 1 is a perspective view illustrating an overall configuration of an inkjet printer according to an exemplary embodiment. FIG. 2 is a side cross-sectional view of the inkjet printer as viewed from the X axis direction. First, the schematic configuration of an inkjet printer 100 (hereinafter also simply referred to as printer 100) according to the embodiment will be described with reference to FIG. 1 and FIG. 2. Note that, in the exemplary embodiment, the inkjet printer 100 using a serial head method will be described as an example. The printer 100 is configured to perform printing on a medium P by discharging ink while moving a head 42 with respect to the medium P.

As illustrated in FIG. 1, the printer 100 includes a transport device 20, a printing unit 40, a pressing unit 60, a pressing unit-support unit 63, a medium support unit 70, and the like. Each unit of the printer 100 is attached to the main frame 10 configuring the transport device 20. Note that, in the exemplary embodiment, an axis along the gravity direction is defined as the Z axis, an axis along a transport direction in which the medium P to be described later is transported is defined as the Y axis, and along the width direction of the medium P is defined as the X axis. Positional relationships along the transport direction of the medium P are also referred to as an "upstream" and a "downstream".

First, a configuration of the transport device 20 will be described.

The transport device 20 includes the main frame 10, a transport belt 23, a first roller 24, a second roller 25, and a third roller 26. The transport device 20 transports the medium P in the transport direction (the direction from the negative side to the positive side in the Y axis direction). As the medium P, for example, natural fiber, cotton, silk, hemp, mohair, wool, cashmere, regenerated fiber, synthetic fiber, nylon, polyurethane, polyester, and woven cloth or non-woven cloth made by mixed spinning of any of these materials can be used. A pretreatment agent for improving color developing properties and fixing properties may be applied to the woven cloth or the non-woven cloth.

The main frame 10 is configured by a plurality of blocks being separably connected along the transport direction (the Y axis direction). In the exemplary embodiment, the plurality of blocks includes a first block 11, a second block 12, and a third block 13. When connected together, the first block 11 is located upstream of the third block 13 in the transport direction (the negative side in the Y axis direction). When connected together, the second block 12 is located downstream of the third block 13 in the transport direction (the positive side in the Y axis direction). For example, the second block 12 is configured by a frame-shaped second base frame 121 forming a bottom surface, and two frame-shaped second side frames 122 that form both of side surfaces in the X axis direction. Similar to the second block 12, the first block 11 and the third block 13 are also configured by a base frame and a side frame. Specifically, the first block 11 is configured by a first base frame 111 and a first side frame 112, and the third block 13 is configured by a third base frame 131 and a third side frame 132.

The first roller 24 is attached to the main frame 10. In the exemplary embodiment, both ends of the first roller 24 are rotatably supported on a support base 24*a*. The support base 24*a* is attached to the upper surface of the first side frame 112 and is disposed at a position at the upstream in the transport direction in the first block 11. The second roller 25 is attached to the main frame 10. In the exemplary embodiment, the second roller 25 is rotatably supported on a support base 25*a*. The support base 25*a* is attached to the upper surface of the second side frame 122 and is disposed at a position at the downstream in the transport direction in the second block 12.

The transport belt 23 is wound around the first roller 24 and the second roller 25, and rotates with supporting the medium P to transport the medium P in the transport direction (the direction from the negative side to the positive side in the Y axis direction). More specifically, the transport belt 23, which is endlessly formed with both end portions of a band-shaped belt being coupled to each other, is hanged between the two rollers, namely, the first roller 24 and the second roller 25. The transport belt 23 is held in a state in which a predetermined tension is applied. A surface 23*a* of the transport belt 23 is provided with an adhesive layer to which the medium P adheres. The transport belt 23 supports the medium P adhered to the adhesive layer by using a pressing unit 60, which will be described later. In this way, an elastic fabric or the like can be used as the medium P.

The first roller 24 and the second roller 25 are provided on an inner side of the transport belt 23 and support a back surface 23*b* of the transport belt 23. The transport device 20 of the exemplary embodiment includes the third roller 26 that supports the transport belt 23 between the first roller 24 and the second roller 25. The third roller 26 is a member that assists in supporting the transport belt 23 to adjust the tension of the transport belt 23, for example. Note that the transport device 20 may have a configuration that does not include a member that assists in supporting the transport belt 23, such as the third roller 26.

The second roller 25 rotates the transport belt 23 to transport the medium P in the transport direction. The second roller 25 includes a rotation driver (not illustrated) for rotationally driving the second roller 25. The second roller 25 is provided at the downstream of the printing unit 40 in the transport direction, while the first roller 24 is provided at the upstream of the printing unit 40 in the transport direction. When the second roller 25 is rotationally driven, the transport belt 23 rotates in accordance with the rotation of the second roller 25, and the first roller 24 is driven to rotate by the rotation of the transport belt 23. The rotation of the transport belt 23 causes the medium P supported on the transport belt 23 to be transported toward the positive side in the Y axis direction in the printing unit 40, and an image or the like is formed on the medium P in the printing unit 40 to be described later. Note that a description is made above of the transport belt 23 which includes the adhesive layer that adheres the medium P, but the transport belt 23 is not limited to this example. For example, the transport belt may be an electrostatic attraction type belt for causing the medium to be attracted to the belt using static electricity.

The transport device 20 may be configured so that a medium supply unit configured to supply the medium P can be connected to the upstream of the transport belt 23 in the transport direction. For example, the medium supply unit rotatably supports the band-like medium P wound in a roll shape, feeds the medium P by rotating the rolled medium P, and supplies the medium P to the transport belt 23.

Further, the transport device 20 may have a configuration in which a medium winding unit that winds the medium P can be connected to the downstream of the transport belt 23 in the transport direction. For example, the medium winding unit includes a winding shaft that is configured to rotatably support, and the band-like medium P is wound in a roll shape by rotating the winding shaft.

Next, the pressing unit 60, the printing unit 40, a carriage movement unit 45, and the medium support unit 70 included in the printer 100 will be described.

The pressing unit 60 is provided in the first block 11, and presses the medium P toward the transport belt 23. The pressing unit 60 is formed in a cylindrical shape or a columnar shape, is provided to be rotatable in a circumferential direction, and rotates in the transport direction of the medium P. The pressing unit 60 is supported between the first roller 24 and the printing unit 40 to be able to move reciprocally along the transport direction. While pressing the medium P from the upper side in the vertical direction (the positive side in the Z axis direction) to the lower side (the negative side in the Z axis direction), the pressing unit 60 is moved by a pressing unit drive unit 62 in the transport direction (from the negative side to the positive side in the Y axis direction) and in an opposite direction to the transport direction (from the positive side to the negative side in the Y axis direction).

The pressing unit-support unit 63 is provided on the inner side of the transport belt 23 and between the first roller 24 and the second roller 25. The pressing unit-support unit 63 is formed in a plate shape and is configured to be able to support the pressing unit 60 via the transport belt 23. A range over which the pressing unit-support unit 63 is formed corresponds to a moving range of the pressing unit 60. Specifically, a length in the X axis direction of the range over which the pressing unit-support unit 63 is formed, corresponds to a length in the X axis direction of the pressing unit 60. In addition, a length in the Y axis direction of the range over which the pressing unit-support unit 63 is formed, corresponds to the moving range of the pressing unit 60 in the Y axis direction. The pressing unit-support unit 63 is supported by four support bases 63*a*, and the support bases 63*a* are attached to the upper face of the first side frame 112. The medium P supplied onto the transport belt 23 is pressed against the transport belt 23 between the pressing unit 60 and the pressing unit-support unit 63. Thus, the medium P can be reliably adhered to the adhesive layer provided on the surface 23*a* of the transport belt 23, and flotation of the medium P on the transport belt 23 can be prevented.

The medium support unit 70 is provided on the inner side of the transport belt 23 and between the first roller 24 and the second roller 25. The medium support unit 70 includes three beam members 71, 72, and 73 each of which has a beam shape that is long in the width direction of the medium P, which is a direction intersecting the transport direction, and is configured to support the medium P via the transport belt 23. As described in detail below, the printer 100 includes the head 42 that moves in the X axis direction. In a plan view from the Z axis direction, a region of the transport belt 23 that overlaps with a moving range of the head 42 is a print region PA. A length in the X axis direction of each of the beam members 71, 72, and 73 is longer than a length in the width direction (the X axis direction) of the transport belt 23. Additionally, the beam members 71, 72, and 73 are disposed in the print region PA to be equally spaced from each other in the Y axis direction. Both ends of each of the beam members 71, 72, and 73 configuring the medium support unit 70 are respectively supported by support bases 71*a*, 72*a*, and 73*a*, and the support bases 71*a*, 72*a*, and 73*a* are mounted on the third side frame 132 of the third block 13. The medium support unit 70 configured by the three beam members 71, 72, and 73 has a smaller component size compared with a medium support unit configured by a flat plate member used in related art, so the accuracy of the components and the precision of assembly are improved. Thus, by causing the height of each of the beam members 71, 72, and 73 in the Z axis direction to be slightly higher than the height of the first roller 24 and the second roller 25, when tension acts on the transport belt 23, the section of the transport belt 23 corresponding to the print region PA is held horizontally.

The printing unit 40 is disposed at a position above (the positive side in the Z axis direction) the transport device 20, and is configured to execute printing on the medium P supported by the transport belt 23. The printing unit 40 includes the head 42, a carriage 43 on which the head 42 is mounted, and the like. A plurality of the heads 42 are replaceably mounted on the carriage 43. The heads 42 mounted on the carriage 43 are moved by the carriage movement unit 45, in the width direction (the X axis direction) of the medium P that intersects the transport direction (the Y axis direction) of the medium P. Ink such as cyan (C), magenta (M), yellow (Y), black (K) or the like, is supplied to each of the heads 42. Each of the heads 42 is configured to discharge ink toward the medium P from nozzles (not illustrated) corresponding to each color.

The printing unit 40 and the carriage movement unit 45 are attached to a support frame 15 extending from the third side frame 132 of the third block 13 to the positive side in the Z axis direction, and are positioned above the transport belt 23 (the positive side in the Z axis direction). The carriage movement unit 45 includes a guide rail 46 extending along in the X axis direction. The heads 42 are supported by the guide rail 46 so that the heads 42 can reciprocate together with the carriage 43 in the X axis direction.

The carriage movement unit 45 includes a moving mechanism and a power source (not illustrated) for causing the carriage 43 to be moved along the guide rail 46. A mechanism including a combination of a ball screw and a ball nut, a linear guide mechanism, or the like may be employed as the moving mechanism. As the power source, a variety of motors such as a stepping motor, a servomotor, and a linear motor may be employed. When the motor is driven, the heads 42 are moved by the moving mechanism along in the X axis direction together with the carriage 43.

The printer 100 prints images, characters, and the like on the medium P by discharging ink from the heads 42 that move in the width direction (the X axis direction) of the medium P with respect to the medium P transported in the transport direction (the Y axis direction) by the transport device 20. Note that in the printer 100 of the exemplary embodiment, the serial-head type head that is mounted on the carriage 43, which moves reciprocatingly, and that is configured to discharge ink while moving in the width direction (the X axis direction) of the medium P is exemplified as the head 42, but the head 42 may be a line-head type head that extends in the width direction of the medium P and discharges ink in a fixed state.

Method for Separating Inkjet Printer

Figure 3:
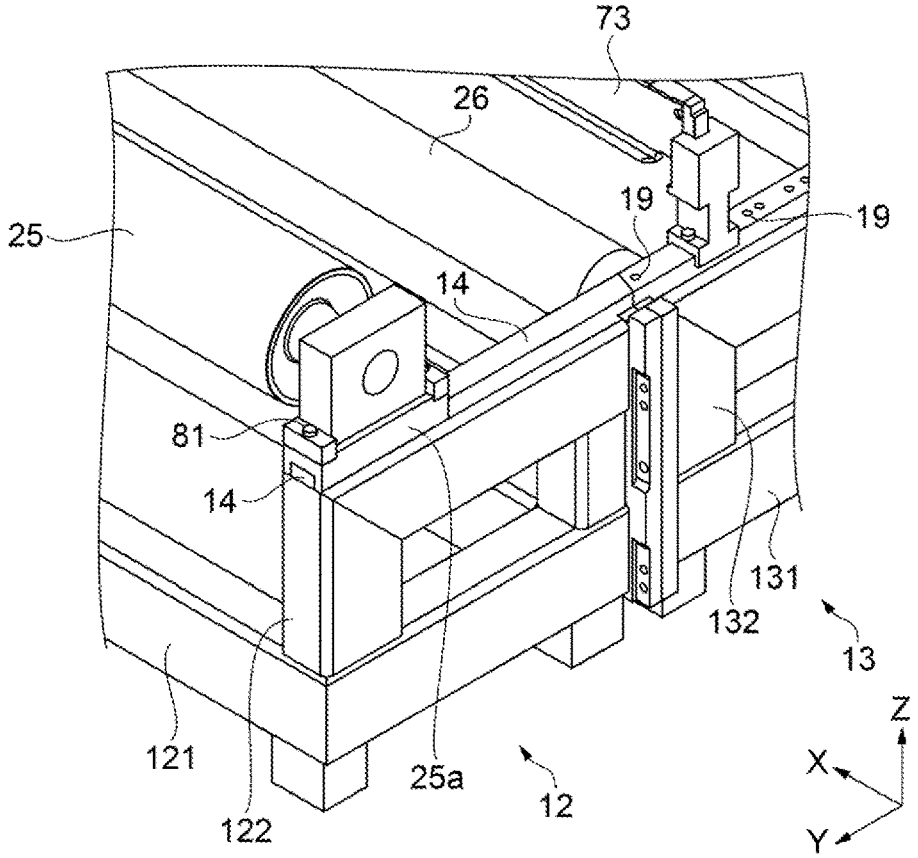
FIG. 3 is a perspective view illustrating a second roller attached to a second block.
Figure 4:
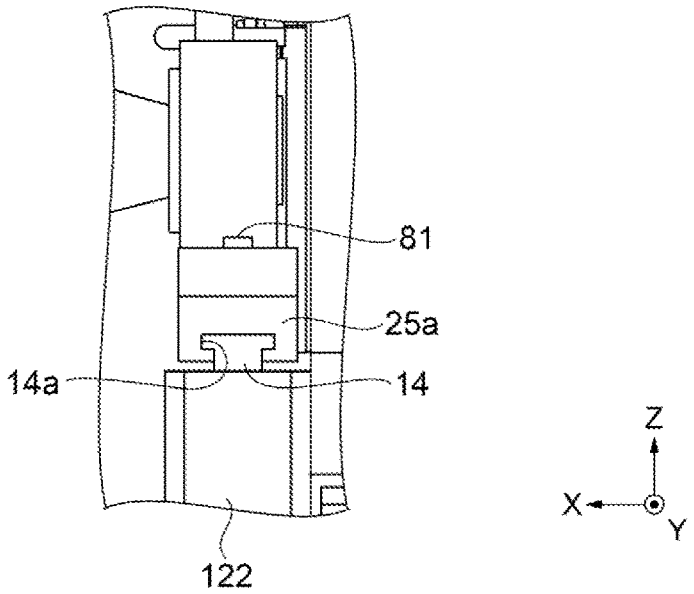
FIG. 4 is a front view illustrating the second roller attached to the second block.
Figure 5:
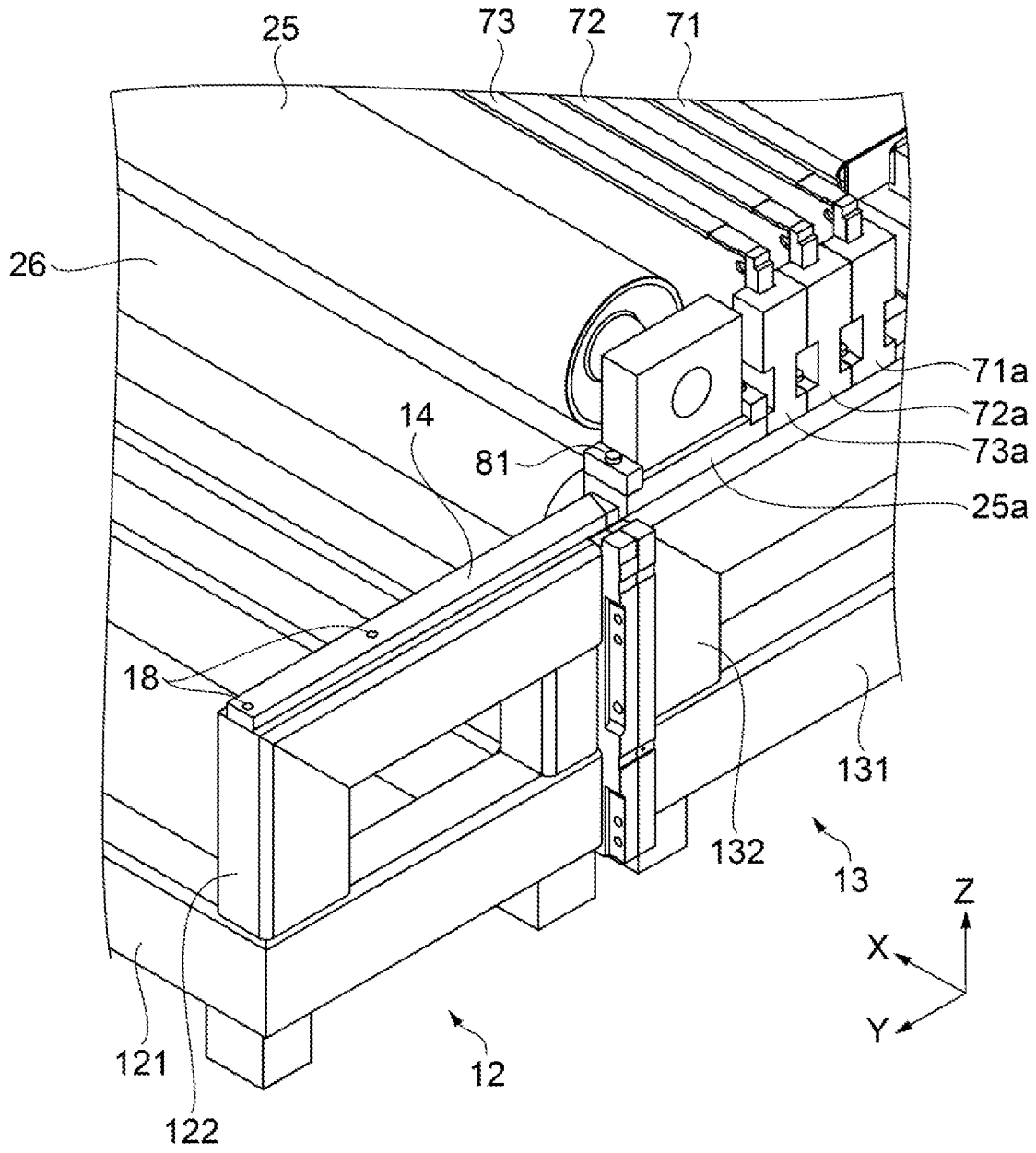
FIG. 5 is a perspective view illustrating the second roller attached to a third block.

Next, a configuration by which the printer 100 is separable will be described. FIG. 3 is a perspective view illustrating the second roller 25 attached to the second block 12. FIG. 4 is a front view (viewed from the positive side in the Y axis direction) illustrating the second roller 25 attached to the second block 12. FIG. 5 is a perspective view illustrating the second roller 25 attached to the third block 13. Note that, for the convenience of explanation, the transport belt 23 is omitted in FIG. 3 and FIG. 5.

At least one of the first roller 24 and the second roller 25 is defined as a roller to be consolidated. The printer 100 is configured to be able to consolidate the first roller 24, the second roller 25, and the transport belt 23 in a consolidation block by moving the roller to be consolidated from a deployment block, which is a block that is fixed when transporting the medium P, to a consolidation block that is a block for the consolidation.

In the exemplary embodiment, the first roller 24 and the second roller 25 are both the rollers to be consolidated. Further, the first block 11 and the second block 12 configuring the main frame 10 are the deployment blocks, and the third block 13 is the consolidation block. When the transport belt 23 transports the medium P, the first roller 24 and the second roller 25 are fixed to different blocks. In other words, in the printer 100, when the transport belt 23 transports the medium P, the first roller 24, which is the roller to be consolidated, is fixed to the first block 11, which is the deployment block, and the second roller 25, which is the roller to be consolidated, is fixed to the second block 12, which is the deployment block.

Then, to separate the printer 100, a configuration is adopted in which the transport device 20 included in the printer 100 moves the first roller 24 from the first block 11 to the third block 13, which is the consolidation block, and moves the second roller 25 from the second block 12 to the third block 13, thus making it possible to consolidate the first roller 24, the second roller 25, and the transfer belt 23 in the third block 13.

As an example, a configuration for moving the second roller 25 will be described with reference to FIGS. 3 to 5.

In the main frame 10, a rail portion 14 is provided in a block included in the moving range of the roller to be consolidated. Since the transport device 20 of the exemplary embodiment moves the first roller 24 from the first block 11 to the third block 13 and the second roller 25 from the second block 12 to the third block 13, the rail portion 14 is provided on the first block 11, the second block 12, and the third block 13. In other words, in the exemplary embodiment, the rail portion 14 is provided across the entire region of the main frame 10. The rail portion 14 is a member that is long in the Y axis direction and is fixed to the upper face (the positive side in the Z axis direction) of each of the side frames (the first side frame 112, the second side frame 122, and the third side frame 132), using a screw or the like.

As illustrated in FIG. 4, when viewed from the positive side in the Y axis direction, the rail portion 14 protrudes to the positive side in the Z axis direction in a state of being fixed to the second side frame 122, and the width (the length in the X axis direction) of the tip is wider than the width (the length in the X axis direction) of the base end. A groove 14*a* corresponding to the shape of the rail portion 14 is formed in the lower surface (the negative side in the Z axis direction) of the support base 25*a* that supports the second roller 25. With the groove 14*a* of the support base 25*a* and the rail portion 14 being slidably engaged with each other, the second roller 25 can move along the Y axis direction without being separated from the main frame 10 in the Z axis direction. As a result, the second roller 25, which is the roller to be consolidated, can be suitably moved between the second block 12, which is the deployment block, and the third block 13, which is the consolidation block.

The second block 12, which is the deployment block for the second roller 25, is provided with a first fixing portion 18 for fixing the second roller 25, which is the roller to be consolidated, when the medium P is transported. In addition, the third block 13, which is the consolidation block, is provided with a second fixing portion 19 for fixing the second roller 25, which is the roller to be consolidated, when consolidating the first roller 24, the second roller 25, and the transport belt 23. The first fixing portion 18 and the second fixing portion 19 are screw holes provided from the upper surface of the rail portion 14 toward the lower side (the negative side in the Z axis direction). The second roller 25 is fixed to the first fixing portion 18 or the second fixing portion 19 by a bolt 81 via the support base 25*a*.

Note that in the exemplary embodiment, the first roller 24, which is the roller to be consolidated, and the pressing unit-support unit 63 and the medium support unit 70 provided in the printer 100 are fixed to each of the blocks by a configuration similar to that of the second roller 25. A configuration for moving the first roller 24, the pressing unit-support unit 63, and the medium support unit 70 will be described below.

The groove 14*a* corresponding to the shape of the rail portion 14 is formed in the support base 24*a* that supports the first roller 24. In addition, the first block 11 includes a first fixing portion (not illustrated) for fixing the first roller 24, which is the roller to be consolidated, when transporting the medium P, and the third block 13 includes a second fixing portion (not illustrated) for fixing the first roller 24, which is the roller to be consolidated, when consolidating the first roller 24, the second roller 25, and the transport belt 23. The first roller 24 is fixed to the first fixing portion or the second fixing portion by the bolt 81 via the support base 24*a*. As a result, the first roller 24 can be moved between the first block 11 and the third block 13 and fixed. In other words, the transport device 20 is configured to consolidate the first roller 24, the second roller 25, and the transport belt 23 in the third block 13, which is the consolidation block, the consolidation being by moving the first roller 24 and the second roller 25, which are the rollers to be consolidated, along the rail portion 14. As a result, the first roller 24 and the second roller 25 can be suitably fixed in predetermined positions.

The groove 14*a* corresponding to the shape of the rail portion 14 is formed in the support base 63*a* that supports the pressing unit-support unit 63. Further, the first block 11 is provided with the first fixing portion (not illustrated) configured to fix the pressing unit-support unit 63 when transporting the medium P, and the third block 13 is provided with the second fixing portion (not illustrated) for fixing the pressing unit-support unit 63 when consolidating the first roller 24, the second roller 25, and the transport belt 23. The pressing unit-support unit 63 is fixed to the first fixing portion or the second fixing portion using the bolt 81 via the support base 63*a*. In other words, the pressing unit-support unit 63 is configured to be movable at least between the first block 11 and the third block 13. Thus, even in a case where the printer 100 includes the pressing unit 60, the pressing unit-support unit 63 can be consolidated and fixed to the third block 13, which is the consolidation block, from the first block 11, which is the deployment block.

The groove 14*a* corresponding to the shape of the rail portion 14 is formed in the support bases 71*a*, 72*a*, and 73*a* that support the three beam members 71, 72, and 73 that configure the medium support unit 70. Further, the third block 13 is provided with the first fixing portion and the second fixing portion (not illustrated) for fixing each of the beam members 71, 72, and 73 of the medium support unit 70. The first fixing portion is a fixing portion for fixing each of the beam members 71, 72, and 73 when transporting the medium P. The second fixing portion is a fixing portion for fixing each of the beam members 71, 72, and 73 when consolidating the first roller 24, the second roller 25, and the transport belt 23. Each of the beam members 71, 72, and 73 is fixed to the first fixing portion or the second fixing portion using the bolt 81, via the respective support bases 71*a*, 72*a*, and 73*a*. An interval between each of the beam members 71, 72, and 73 when each of the beam members 71, 72, and 73 are fixed to the second fixing portion is configured to be narrower than an interval between each of the beam members 71, 72, and 73 when each of the beam members 71, 72, and 73 are fixed to the first fixing portion. In other words, the medium support unit 70 is configured to change a deployment range in the transport direction in the third block 13. Fixing each of the beam members 71, 72, and 73 to the second fixing portion narrows the interval between each of the beam members 71, 72, and 73 and shrinks the deployment range of the medium support 70. As a result, a space to contain the first roller 24, the second roller 25, and the pressing unit-support unit 63 can be suitably secured in the third block 13.

Figure 6:
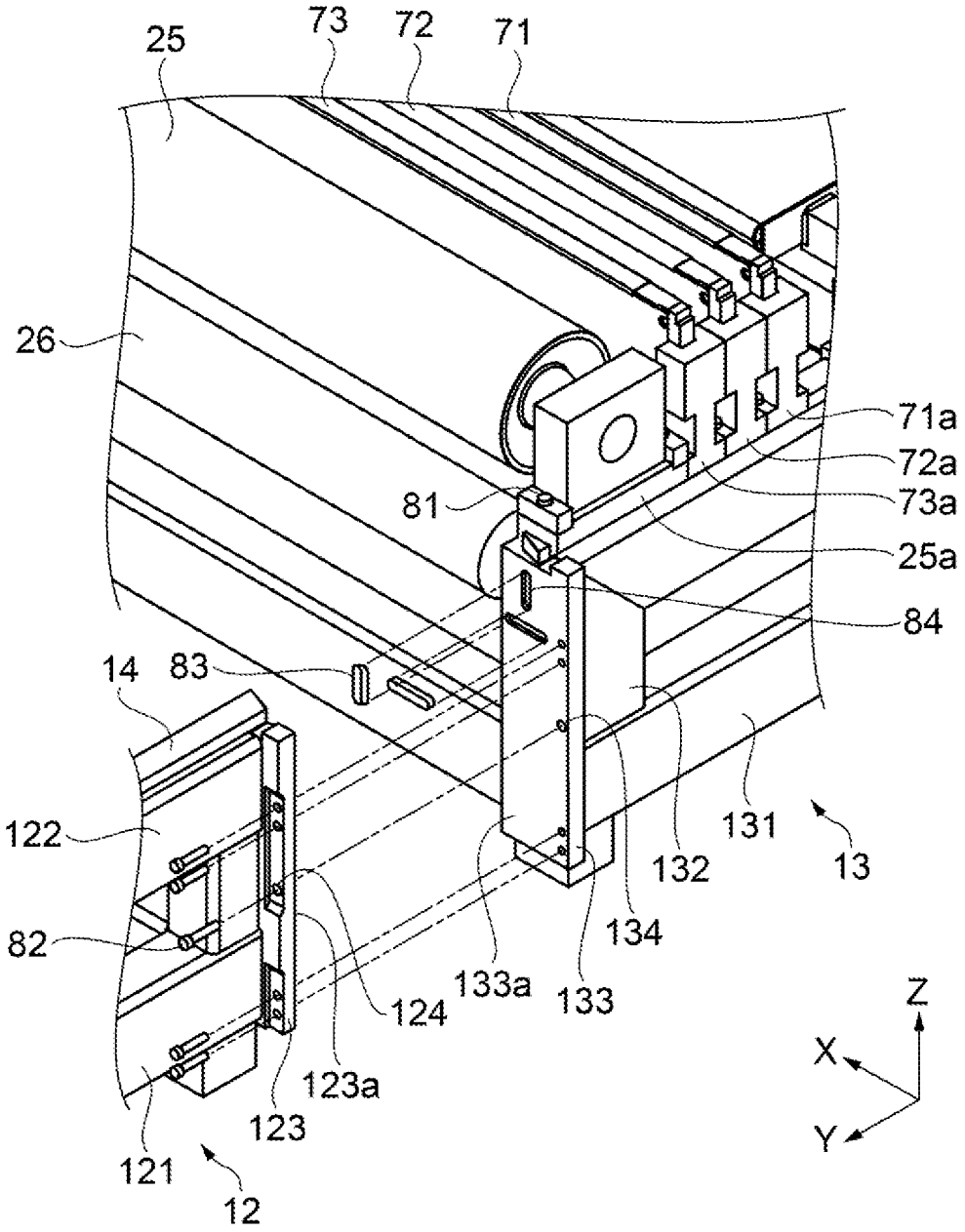
FIG. 6 is a diagram of separation and assembly of the second block and the third block.
Figure 7:
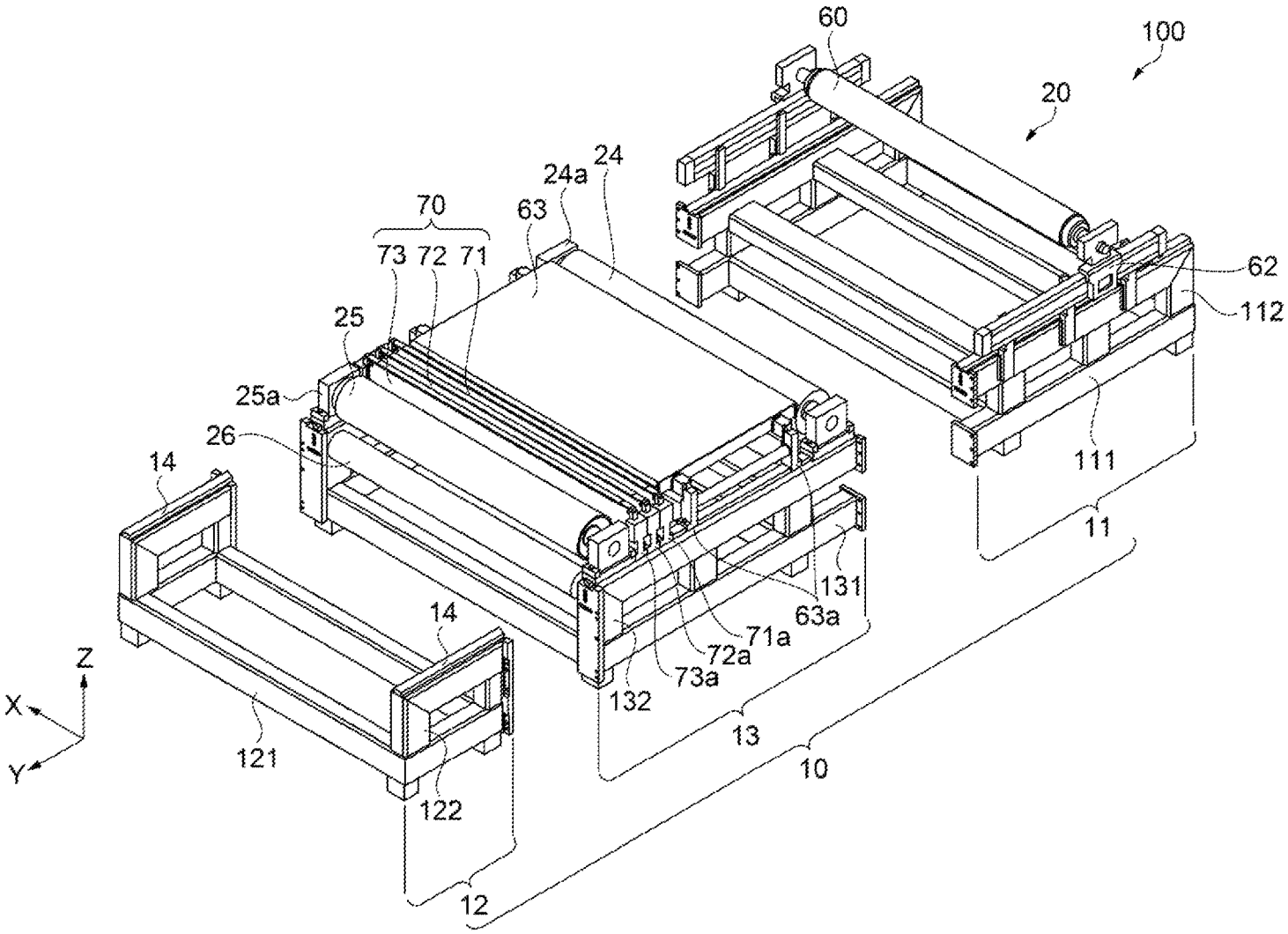
FIG. 7 is a perspective view illustrating a main frame after separation.

The main frame 10 of the transport device 20 is configured to be separable into the first block 11, the second block 12, and the third block 13. As an example, a configuration for separating the second block 12 and the third block 13 will be described with reference to FIG. 6 and FIG. 7. FIG. 6 is a diagram of separation and assembly of the second block 12 and the third block 13. FIG. 7 is a perspective view illustrating the main frame 10 after separation. For the convenience of explanation, the transport belt 23 is omitted in FIG. 6, and the printing unit 40, the carriage movement unit 45, and the transport belt 23 are omitted in FIG. 7.

The second block 12 is provided with a second joining member 123 coupled to the negative side in the Y axis direction of the second side frame 122 that configures the second block 12. The third block 13 is provided with a third joining member 133 coupled to the positive side in the Y axis direction of the third side frame 132 that configures the third block 13. The second joining member 123 and the third joining member 133 oppose each other, the second joining member 123 includes a second joining surface 123*a* on a surface opposing the third joining member 133, and the third joining member 133 includes a third joining surface 133*a* on a surface opposing the second joining member 123.

A plurality of through holes 124 formed along the Y axis direction are provided in the second joining member 123, and internal threads that screw with external thread provided on bolts 82 are formed on inner circumferences of through holes 124. A plurality of through holes 134, through which the bolts 82 are passed, are provided in the third joining member 133 along the Y axis direction. The second block 12 and the third block 13 are separably connected by the plurality of bolts 82 that couple the second joining member 123 and the third joining member 133.

The third joining member 133 and the second joining member 123 are coupled via a positioning key 83 for increasing the positional accuracy when connected. The positioning key 83 is a rectangular columnar steel bar and has a tip machined into a semi-circular shape. Two key seats 84 corresponding to the shape of the positioning key 83 are formed in each of the second joining surface 123*a* and the third joining surface 133*a*. One of the key seats 84 is a groove that is long in the X axis direction, and the positioning key 83 fits into the key seat 84, so that the second block 12 and the third block 13 are accurately connected in terms of a height position (a position in the Z axis direction). The other key seat 84 is a groove that is long in the Z axis direction, and the positioning key 83 fits into the key seat 84, so that the second block 12 and the third block 13 are accurately connected in terms of a position in the X axis direction.

The first block 11 and the third block 13 are separably connected in a similar manner. As a result, as illustrated in FIG. 7, the main frame 10 can be separated into the first block 11, the second block 12, and the third block 13, and can be united once more. Note that in the exemplary embodiment, a configuration is exemplified in which the positioning key 83 is used to increase the positional accuracy, but a configuration may be adopted in which a positioning pin or the like is used instead of the positioning key 83.

Figure 8:
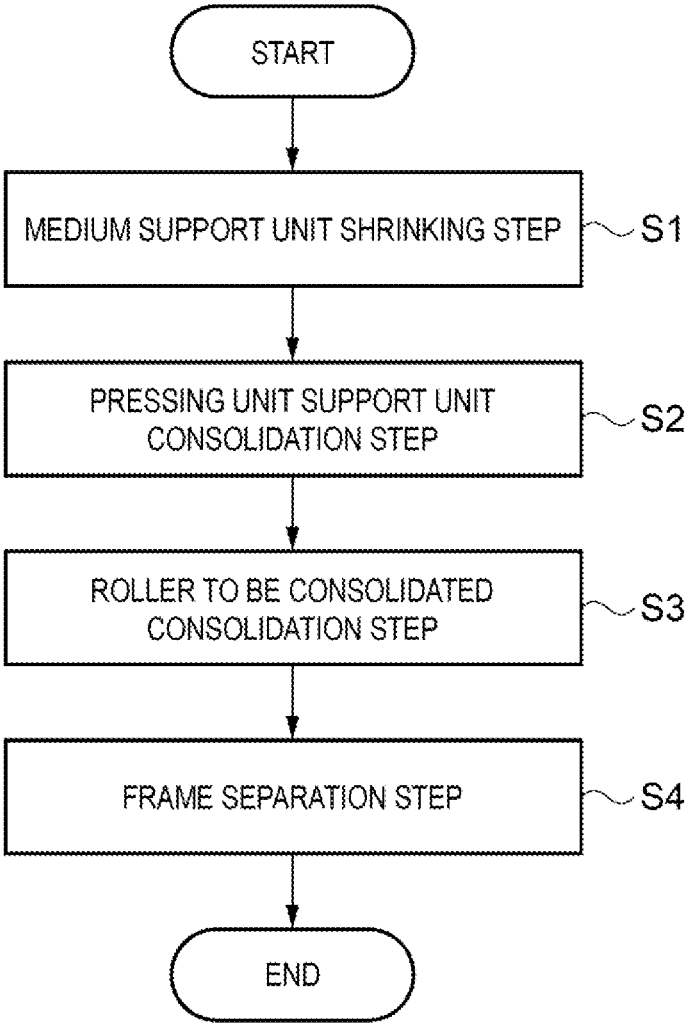
FIG. 8 is a flowchart illustrating a method for separating the inkjet printer.

Next, a method for separating the printer 100 will be described with reference to FIGS. 8 to 13. FIG. 8 is a flowchart illustrating the method for separating the inkjet printer. FIGS. 9 to 13 are perspective views illustrating each of the separation steps. For the convenience of explanation, the printing unit 40, the carriage movement unit 45, and the transport belt 23 are omitted in FIGS. 9 to 12, and the printing unit 40 and the carriage movement unit 45 are omitted in FIG. 13.

Figure 9:
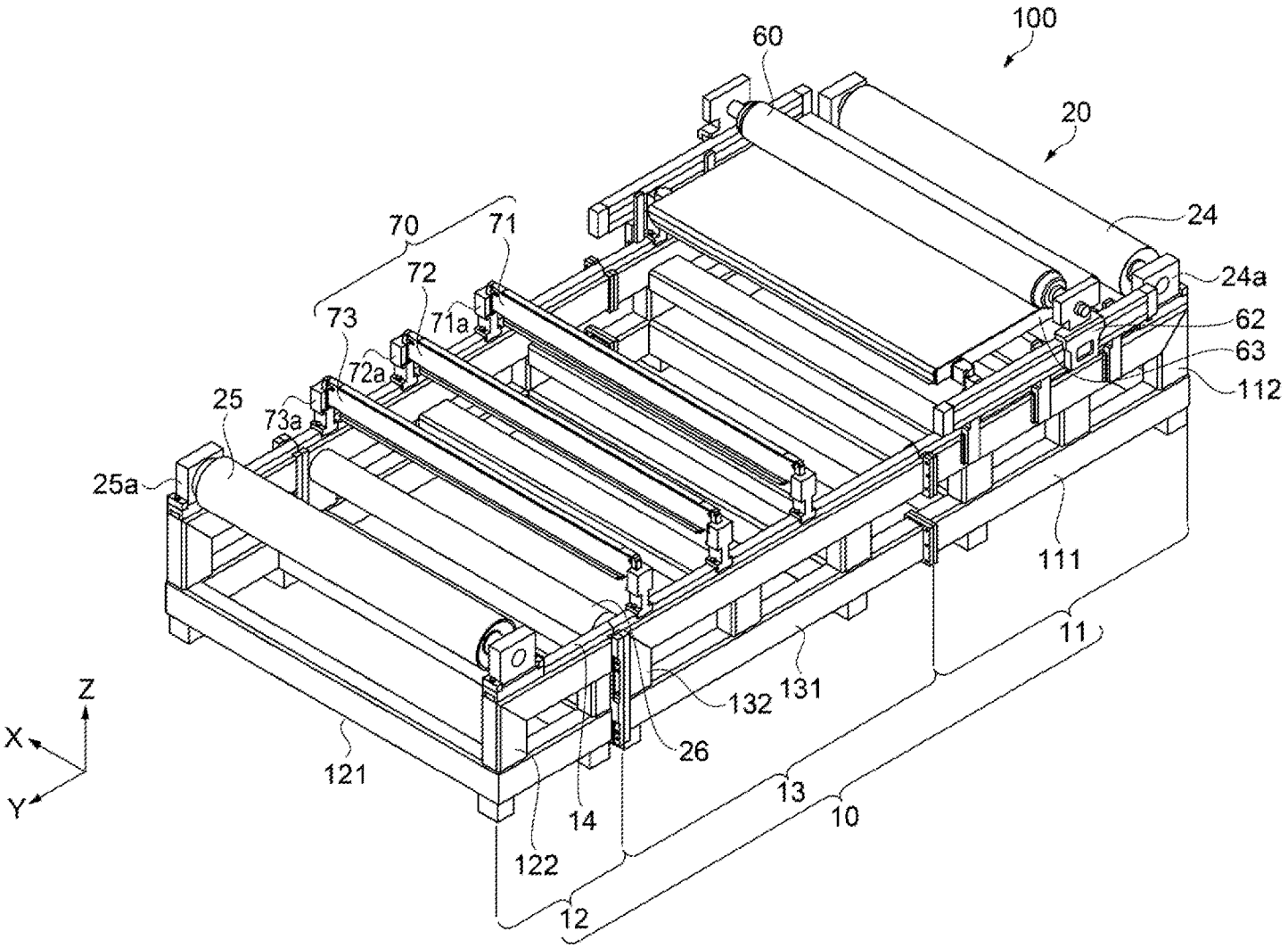
FIG. 9 is a perspective view illustrating a separation step.
Figure 10:
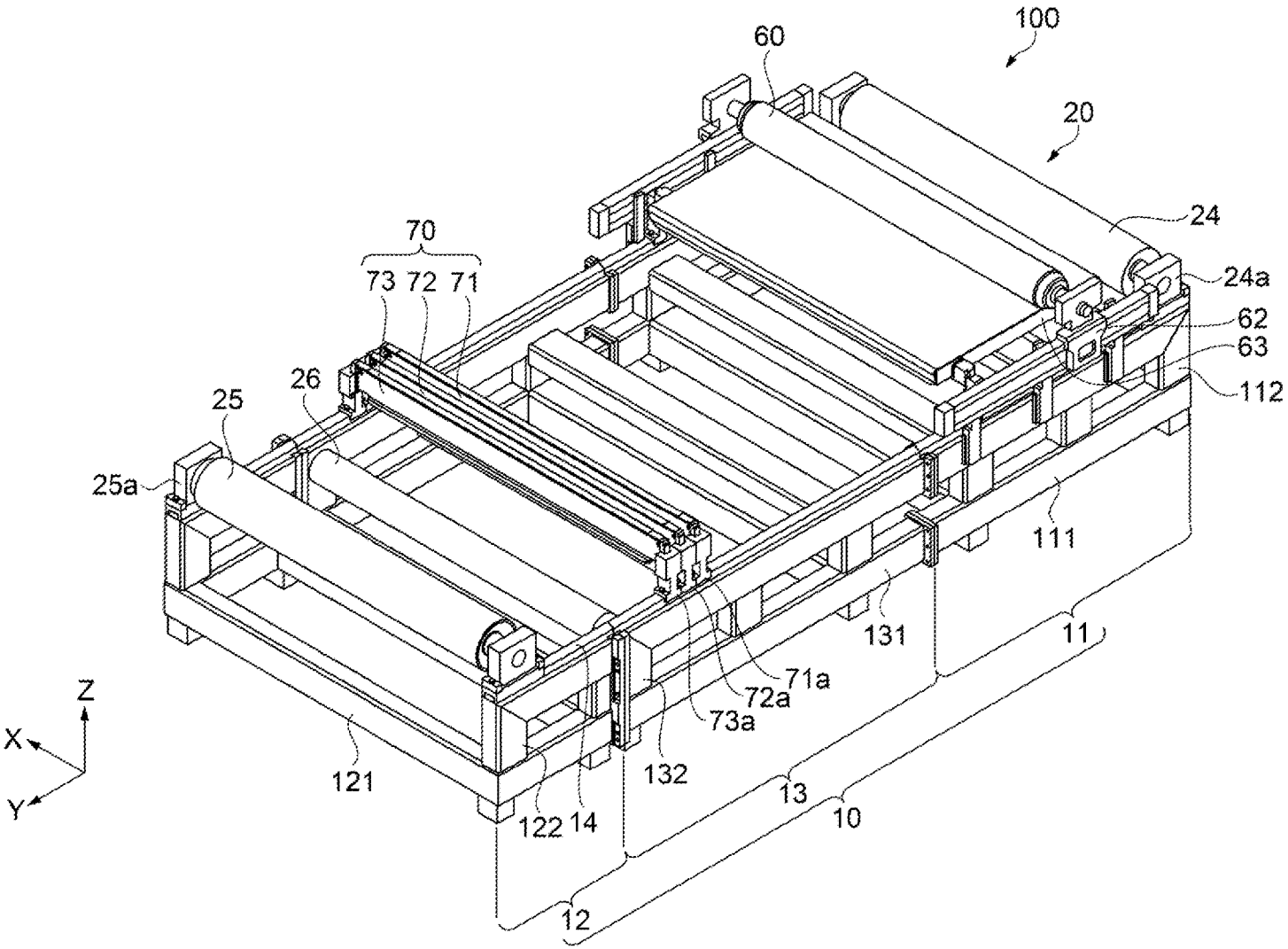
FIG. 10 is a perspective view illustrating the separation step.

Step S1 is a medium support unit shrinking step for shrinking the deployment range of the medium support unit 70. As illustrated in FIG. 9, each of the beam members 71, 72, and 73 of the medium support unit 70 is fixed to a position (a deployment position) corresponding to the first fixing portion of the third block 13 when the medium P is transported. As illustrated in FIG. 10, a user moves and fixes each of the beam members 71, 72, and 73 in a position (a consolidation position) corresponding to the second fixing portion of the third block 13. As a result, the deployment range of the medium support unit 70 in the transport direction shrinks. Note that in the exemplary embodiment, each of the fixing portions (the first fixing portion and the second fixing portion) used to fix the medium support unit 70 is the screw hole. Thus, in a state in which the medium support unit 70 is moved to a position corresponding to each of the fixing portions, the medium support unit 70 is fixed by attaching screws to each of the fixing portions from above the medium support unit 70. In addition, by removing the screws from each of the fixing portions, the fixing of the medium support unit 70 is released, and the medium support unit 70 is in a state of being movable.

Figure 11:
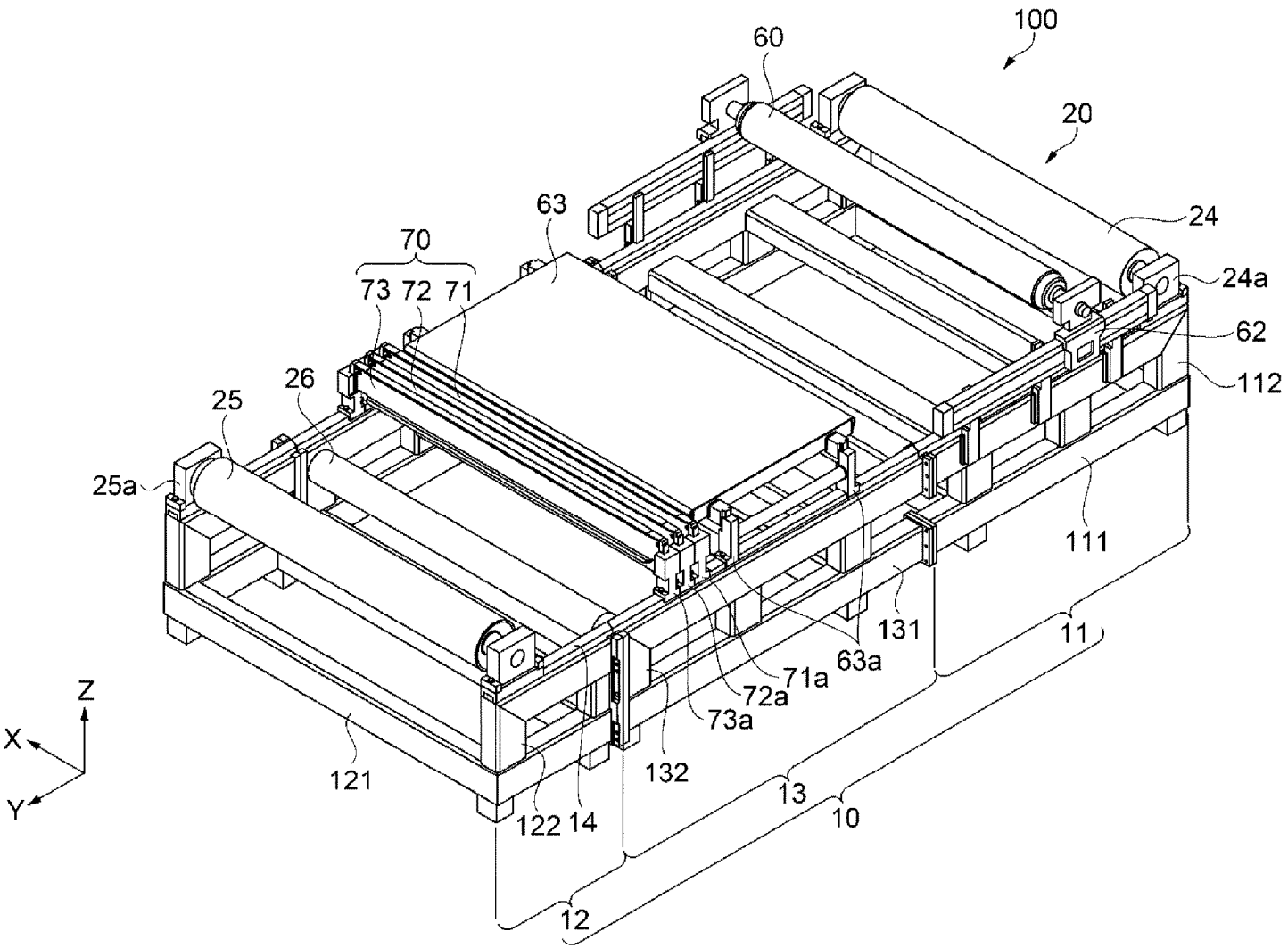
FIG. 11 is a perspective view illustrating the separation step.

Step S2 is a pressing unit-support unit consolidation step for consolidating the pressing unit-support unit 63 in the consolidation block. As illustrated in FIG. 10, the pressing unit-support unit 63 is fixed to a position (a deployment position) corresponding to the first fixing portion of the first block 11 when the medium P is transported. As illustrated in FIG. 11, the user moves and fixes the pressing unit-support unit 63 to a position (a consolidation position) corresponding to the second fixing portion of the third block 13, which is the consolidation block. As a result, the first roller 24 provided upstream of the pressing unit-support unit 63 in the transport direction can move from the first block 11 to the third block 13. Note that in the embodiment, each of the fixing portions (the first fixing portion and the second fixing portion) used to fix the pressing unit-support unit 63 is the screw hole. Therefore, in a state in which the pressing unit-support unit 63 is moved to the position corresponding to each of the fixing portions, the pressing unit-support unit 63 is fixed by attaching a screw to each of the fixing portions from above the pressing unit-support unit 63. In addition, by removing the screw from each of the fixing portions, the fixing of the pressing unit-support unit 63 is released, and the pressing unit-support unit 63 is in a state of being movable.

Figure 12:
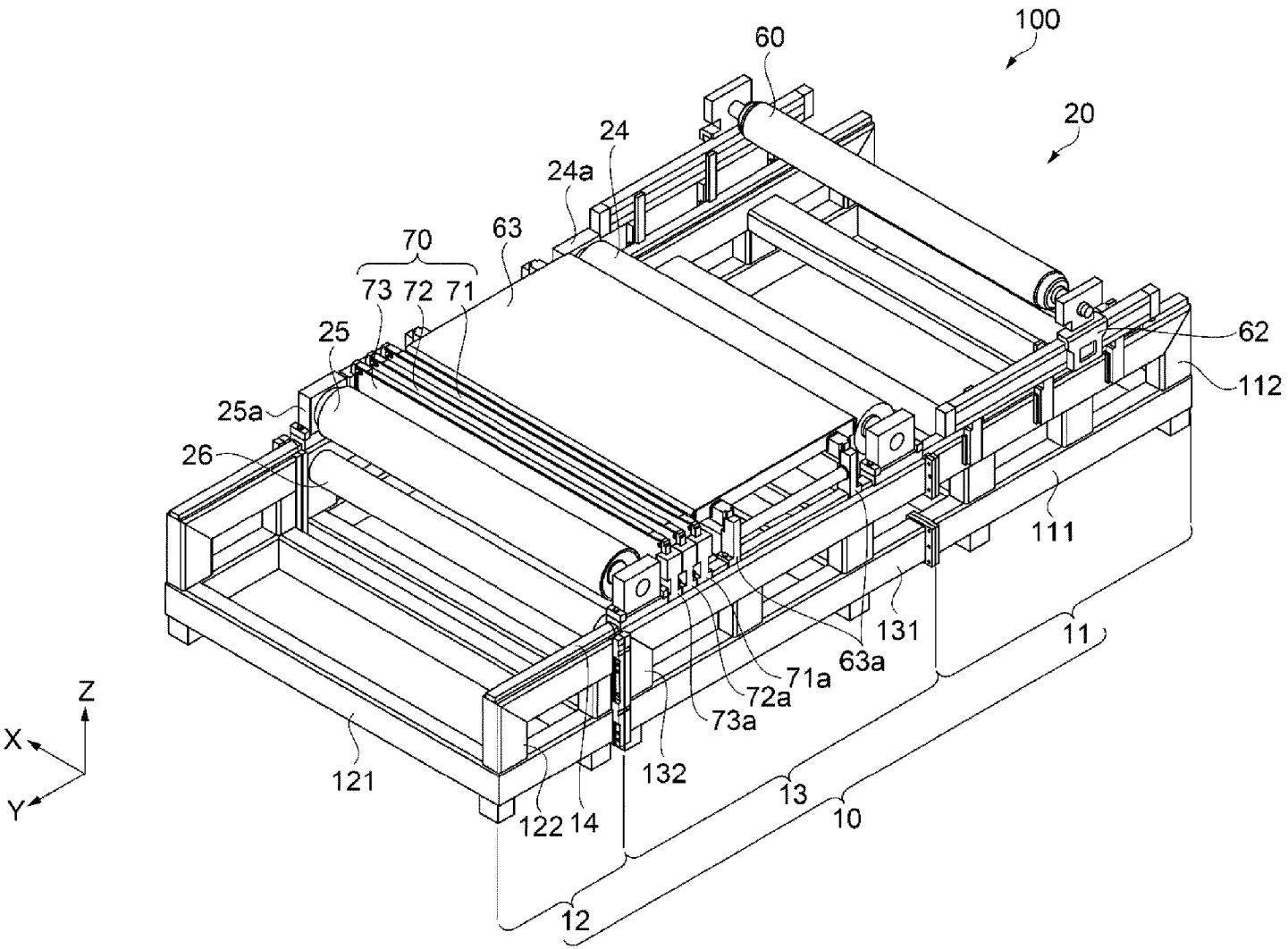
FIG. 12 is a perspective view illustrating the separation step.
Figure 13:
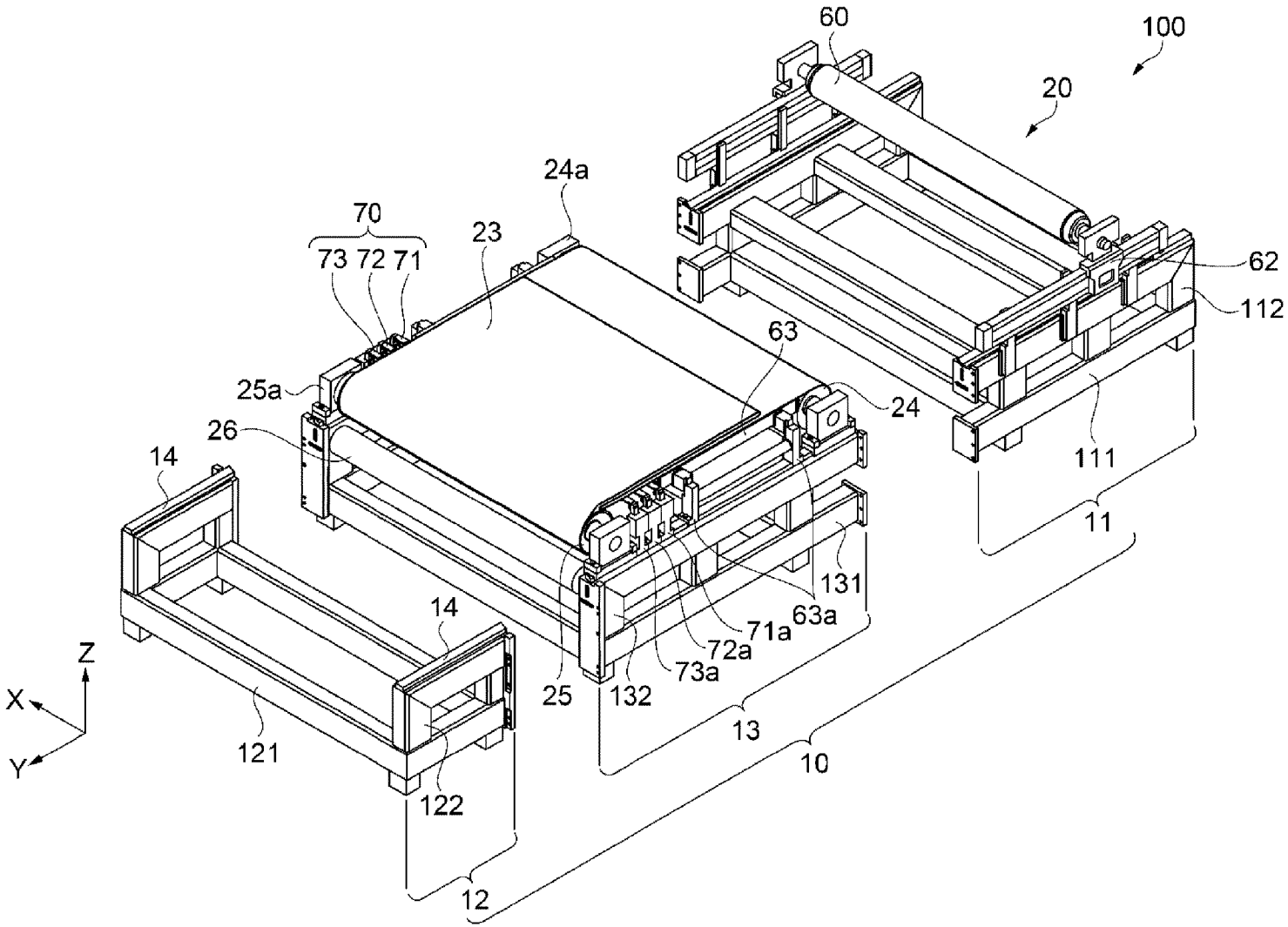
FIG. 13 is a perspective view illustrating the separation step.

Step S3 is a roller to be consolidated consolidation step for consolidating the rollers to be consolidated in the consolidation block. As illustrated in FIG. 11, the first roller 24, which is the roller to be consolidated, is fixed in a position (a deployment position) corresponding to the first fixing portion of the first block 11, which is the block for deployment (the deployment block), when the medium P is transported. As illustrated in FIG. 12, the user moves the first roller 24 from the first block 11 and fixes the first roller 24 to a position corresponding to the second fixing portion (a consolidation position) of the third block 13, which is the block for consolidation (the consolidation block). In addition, as illustrated in FIG. 11, the second roller 25, which is the roller to be consolidated, is fixed in a position (a deployment position) corresponding to the first fixing portion 18 of the second block 12, which is the block for deployment (the deployment block), when the medium P is transported. As illustrated in FIG. 12, the user moves the second roller 25 from the second block 12 and fixes the second roller 25 to a position (a consolidation position) corresponding to the second fixing portion 19 of the third block 13, which is the block for consolidation (the consolidation block). When the first roller 24 and the second roller 25 are consolidated in the third block 13, slack occurs in the transport belt 23 because the distance between the first roller 24 and the second roller 25 becomes shorter. The user pulls a slack portion of the transfer belt 23 up to the upper side (the positive side in the Z axis direction) of the transfer belt 23, and folds the slack portion. FIG. 13 is a diagram illustrating step S4 to be described below, and FIG. 13 illustrates the transport belt 23 in a folded state. As illustrated in FIG. 13, the transfer belt 23 is held compactly as the slack portion is folded. As a result, the first roller 24, the second roller 25, and the transfer belt 23 are consolidated in the third block 13, which is the consolidation block.

Step S4 is a frame separation step in which the main frame 10 is separated into at least a portion including a consolidation block and a portion including a deployment block. As illustrated in FIG. 13, the user separates the third block 13, which is the consolidation block, and the first block 11, which is the deployment block. Then, the user separates the third block 13, which is the consolidation block, and the second block 12, which is the deployment block. As a result, the main frame 10 of the transport device 20 included in the printer 100 can be easily separated into the three blocks (the first block 11, the second block 12, and the third block 13) without removing the transport belt 23 from the first roller 24 and the second roller 25. Therefore, the printer 100 can be suitably transported from and loaded into a building or container.

Each of the separated blocks (the first block 11, the second block 12, and the third block 13) is configured to have a length in the transport direction of not greater than 2352 mm. In the transport device 20 of the exemplary embodiment, the length of the first block 11 in the transport direction is approximately 1800 mm, the length in the transport direction of the second block 12 is approximately 800 mm, and the length in the transport direction of the third block 13 is approximately 2100 mm. When shipping the printer 100, it is preferable to use a dry container. The dry container is standardized in size by the International Organization for Standardization (ISO), and the width of the internal dimension of the dry container is 2352 mm. Therefore, by configuring the length of each block in the transport direction to be not greater than 2352 mm, the printer 100 separated into the blocks can be suitably shipped in the dry container.

Note that, although different from the exemplary embodiment, when it is assumed that the printer 100 is loaded from a door of a general building, each of the separated blocks (the first block 11, the second block 12, and the third block 13) is configured so that a length in the transport direction is not greater than 900 mm. Public buildings, corporate buildings, and the like are often built based on the guiding standards of promoting smooth mobility in buildings and others under the Barrier Free Act, and entrances of the buildings are prescribed to have a width dimension of equal to or greater than 900 mm. Therefore, by configuring the length of each of the blocks of the transport device 20 in the transport direction to be not greater than 900 mm, the printer 100 can easily be loaded into a building that is built based on the guiding standards of promoting smooth mobility in buildings and others under the Barrier Free Act.

Note that also in JIS A 4702:2015 Door Set, the dimension of a door set for wheelchair users is also set to be equal to or greater than an effective width of 900 mm, and thus, by configuring the length of each of the blocks of the transport device 20 in the transport direction to be not greater than 900 mm, it is possible to load the printer 100 from a door assumed to be used by the wheelchair user. However, because the width of the door of the building may be sufficiently wider than 900 mm, such as in a factory, the length of each block of the transport device 20 in the transport direction need not necessarily be 900 mm or less (in the exemplary embodiment, the first block 11 and the third block 13 do not have a length in the transport direction of not greater than 900 mm).

Note that in the exemplary embodiment, a configuration is exemplified in which the first roller 24 and the second roller 25 are the rollers to be consolidated, and the main frame 10 can be separated into the three blocks, namely, the third block 13, which is the consolidation block, and the first block 11 and the second block 12, which are the deployment blocks. However, exemplary embodiments of the present disclosure are not limited thereto. For example, the main frame may be configured by a first block that is a deployment block and a second block that is a consolidation block. The second roller may be provided in the second block, and, by moving only the first roller as a roller to be consolidated from the first block to the second block, the main frame may be separated into two blocks, namely, the first block and the second block. Additionally, a plurality of blocks configuring the main frame may be configured to include a block (an intermediate block) other than the deployment block and the consolidation block. That is, the plurality of blocks configuring the main frame may be two or equal to or greater than four.

As described above, according to the printer 100 and the method for separating the printer 100 of the exemplary embodiment, the following effects can be obtained.

The printer 100 is provided with the transport device 20. The transport device 20 includes the main frame 10, the first roller 24 and the second roller 25 attached to the main frame 10, and the transport belt 23 wound around the first roller 24 and the second roller 25. The main frame 10 is configured so that the first block 11, which is the deployment block, the second block 12, which is the deployment block, and the third block 13, which is the consolidation block, are separably connected together while being arranged in the order of the first block 11, the third block 13, and the second block 12 from the upstream in the transport direction. When transporting the medium P, the first roller 24, which is the roller to be consolidated, is fixed to the first block 11, and the second roller 25, which is the roller to be consolidated, is fixed to the second block 12. When relocating the printer 100, the first roller 24 is moved from the first block 11 to the third block 13 and the second roller 25 is moved from the second block 12 to the third block 13. As a result, the main frame 10 of the transport device 20 can be easily separated into the third block 13, which is the consolidation block, and the first block 11 and the second block 12, which are the deployment blocks, without removing the transport belt 23 from the first roller 24 and the second roller 25. Therefore, the printer 100 can be suitably transported from and loaded into a building or container.

The rail portion 14 is provided on each of the blocks (the first block 11, the second block 12, and the third block 13) included in the moving range of the rollers to be consolidated (the first roller 24 and the second roller 25). As a result, the first roller 24, which is the roller to be consolidated, can be moved between the first block 11, which is the deployment block, and the third block 13, which is the consolidation block. In addition, the second roller 25, which is the roller to be consolidated can be suitably moved between the second block 12, which is the deployment block, and the third block 13, which is the consolidation block.

The first block 11, which is the deployment block, is provided with the first fixing portion for fixing the first roller 24, which is the roller to be consolidated. The second block 12, which is the deployment block, is provided with the first fixing portion 18 for fixing the second roller 25, which is the roller to be consolidated. The third block 13, which is the consolidation block, is provided with the second fixing portion for fixing the first roller 24 and the second fixing portion 19 for fixing the second roller 25. As a result, the rollers to be consolidated (the first roller 24 and the second roller 25) can be suitably fixed in predetermined positions.

Each of the separated blocks (the first block 11, the second block 12, and the third block 13) has a length in the transport direction of not greater than 2352 mm. When shipping the printer 100, it is preferable to use a dry container. Since the width of the internal dimensions of the container is 2352 mm, the printer 100 can be suitably shipped in the dry container.

The printer 100 includes the medium support unit 70 configured to allow the deployment range in the transport direction to be changed within the third block 13. By shrinking the deployment range of the medium support unit 70, the space containing the first roller 24, the second roller 25, and the pressing unit-support unit 63 can be suitably secured in the third block 13.

The printer 100 includes the pressing unit 60 that is provided in the first block 11 and that is configured to press the medium P toward the transport belt 23, and the pressing unit-support unit 63 that is provided on the inner side of the transport belt 23 and between the first roller 24 and the second roller 25. Since the pressing unit-support unit 63 is configured to be movable between the first block 11 and the third block 13, even when the printer 100 is provided with the pressing unit 60, the pressing unit-support unit 63 can be consolidated in the third block 13, which is the consolidation block, from the first block 11, which is the deployment block.

According to the method for separating the printer 100, when relocating the printer 100, the user moves the first roller 24, which is the roller to be consolidated, from the first block 11, which is the deployment block, to the third block 13, which is the consolidation block. The second roller 25, which is the roller to be consolidated, is moved from the second block 12, which is the deployment block, to the third block 13, which is the consolidation block. As a result, the first roller 24, the second roller 25, and the transport belt 23 can be consolidated in the third block 13, which is the consolidation block. Then, the user separates the third block 13, which is the consolidation block, and the first block 11 and the second block 12, which are the deployment blocks. As a result, the main frame 10 of the transport device 20 can be easily separated into the third block 13, which is the consolidation block, and the first block 11 and the second block 12, which are the deployment blocks, without removing the transport belt 23 from the first roller 24 and the second roller 25. Therefore, the printer 100 can be suitably transported from and loaded into a building or container.

Contents derived from the exemplary embodiments will be described below.

An inkjet printer according to the present application includes a main frame, a first roller attached to the main frame, a second roller attached to the main frame, a transport belt wound around the first roller and the second roller and configured to transport a medium in a transport direction by rotating while supporting the medium, and a printing unit configured to perform printing on the medium supported on the transport belt. The main frame is configured of a plurality of blocks that are separably connected with one another in the transport direction, and at least one of the first roller and the second roller is defined as a roller to be consolidated. The first roller, the second roller, and the transport belt are configured to be consolidated in a consolidation block, which is a block for consolidation, by moving the roller to be consolidated from a deployment block, which is a block where the roller to be consolidated is fixed when the medium is transported, to the consolidation block.

According to this configuration, the inkjet printer includes the transport belt wound around the first roller and the second roller attached to the main frame. The main frame is configured by the plurality of blocks, including the deployment block and the consolidation block, being separably connected along the transport direction. At least one of the first roller and the second roller is the roller to be consolidated. When transporting the medium, the roller to be consolidated is fixed to the deployment block. When relocating the inkjet printer, the first roller, the second roller, and the transport belt can be consolidated in the consolidation block by moving the roller to be consolidated from the deployment block to the consolidation block. As a result, the main frame can be easily separated into the consolidation block and the deployment block without removing the transport belt from the first roller and the second roller. Thus, the inkjet printer can be suitably transported from and loaded into a building or container.

In the above-described inkjet printer, in the main frame, a rail portion may be provided in each of the blocks included in a moving range of the roller to be consolidated, and the first roller, the second roller, and the transport belt may be configured to be consolidated in the consolidation block by moving the roller to be consolidated along the rail portion.

According to this configuration, the rail portion is provided in the deployment block and the consolidation block included in the moving range of the roller to be consolidated. The roller to be consolidated is configured to be movable between the deployment block and the consolidation block along the rail portion. As a result, the roller to be consolidated can be suitably moved.

In the above-described inkjet printer, the deployment block may be provided with a first fixing portion for fixing the roller to be consolidated when the medium is transported, and the consolidation block may be provided with a second fixing portion for fixing the roller to be consolidated when the first roller, the second roller, and the transport belt are consolidated in the consolidation block.

According to this configuration, the deployment block is provided with the first fixing portion for fixing the roller to be consolidated, and the consolidation block is provided with the second fixing portion for fixing the roller to be consolidated. As a result, the roller to be consolidated can be suitably fixed in a predetermined position.

In the above-described inkjet printer, a length of each of the plurality of blocks may be configured to be not greater than 2352 mm in the transport direction.

According to this configuration, the length in the transport direction of each of the consolidation block and the deployment block formed by separating the main frame is not greater than 2352 mm. When shipping the inkjet printer, it is preferable to use the dry container. Because the width of the internal dimension of the container is 2352 mm, the inkjet printer separated into the blocks can be suitably shipped in the dry container.

In the above-described inkjet printer, the plurality of blocks may include a first block as the deployment block, a second block as the deployment block, and a third block as the consolidation block, the first block may be positioned upstream of the third block in the transport direction when the first block is connected with the third block, and the second block may be positioned downstream of the third block in the transport direction when the second block is connected with the third block. The first roller may be fixed in the first block, and the second roller may be fixed in the second block when the medium is transported by the transport belt, and the first roller, the second roller, and the transport belt may be configured to be consolidated in the third block by moving the first roller from the first block to the third block and moving the second roller from the second block to the third block.

According to this configuration, the main frame of the inkjet printer is configured by the plurality of blocks arranged in the order of the first block, the third block, and the second block from the upstream in the transport direction, being separably connected along the transport direction. When transporting the medium, the first roller is fixed to the first block, and the second roller is fixed to the second block. When shipping the inkjet printer, by moving the first roller from the first block to the third block and the second roller from the second block to the third block, the first roller, the second roller, and the transfer belt can be consolidated in the third block without removing the transfer belt from the first roller and the second roller. As a result, the main frame can be easily separated in the first to third blocks, and the inkjet printer can be suitably transported from and loaded into a building or container.

The above-described inkjet printer may include a medium support unit provided at an inside of the transport belt and in a region between the first roller and the second roller, and configured to support the medium via the transport belt. The printing unit and the medium support unit may be attached in the third block, and the medium support unit may be configured to change a deployment range in the transport direction in the third block.

According to this configuration, the inkjet printer includes the medium support unit configured to allow the deployment range in the transport direction to be changed within the third block. By shrinking the deployment range of the medium support unit, the space for consolidating the first roller and the second roller in the third block can be suitably secured.

The above-described inkjet printer may include a pressing unit provided in the first block and configured to press the medium toward the transport belt, and a pressing unit-support unit provided at an inside of the transport belt and in a region between the first roller and the second roller, and configured to support the pressing unit via the transport belt. The pressing unit-support unit may be configured to move at least between the first block and the third block.

According to this configuration, the inkjet printer includes the pressing unit that presses the medium toward the transport belt, and the pressing unit-support unit that is able to support the pressing unit via the transport belt. The pressing unit-support unit provided between the first roller and the second roller is configured to be movable between the first block and the third block. Thus, even in the inkjet printer provided with a pressing unit, the first roller can be consolidated from the first block to the third block.

A method for separating an inkjet printer according to the present application is a method for separating an inkjet printer including a main frame, a first roller attached to the main frame, a second roller attached to the main frame, a transport belt wound around the first roller and the second roller and configured to transport the medium in a transport direction by rotating while supporting the medium, and a printing unit configured to perform printing on the medium supported on the transport belt, the main frame being configured by a plurality of blocks that are separably connected with one another in the transport direction, and the first roller and the second roller being fixed to the blocks that are different from each other when the transport belt transports the medium. The method includes, defining at least one of the first roller and the second roller as a roller to be consolidated, consolidating the first roller, the second roller, and the transport belt in a consolidation block, which is a block for consolidation, by moving the roller to be consolidated from a deployment block, which is a block where the roller to be consolidated is fixed when the medium is transported, to the consolidation block, and separating the main frame at least into a part including the consolidation block and a part including the deployment block.

According to this method for separating the inkjet printer, when shipping the inkjet printer, the roller to be consolidated fixed to the deployment block is moved to the consolidation block, and the first roller, the second roller, and the transport belt are consolidated in the consolidation block. Furthermore, the main frame is separated into the portion including the consolidation block and the portion including the deployment block. As a result, the main frame can be easily separated into the plurality of blocks without removing the transfer belt from the first roller and the second roller. Thus, the inkjet printer can be suitably transported from and loaded into a building or container.

What is claimed is:

1. An inkjet printer comprising:

a main frame;

a first roller attached to the main frame;

a second roller attached to the main frame;

a transport belt wound around the first roller and the second roller and configured to transport a medium in a transport direction by rotating while supporting the medium; and a printing unit configured to perform printing on the medium supported on the transport belt, wherein the main frame is configured of a plurality of blocks that are separably connected with one another in the transport direction, at least one of the first roller and the second roller is defined as a roller to be consolidated, and the first roller, the second roller, and the transport belt are configured to be consolidated in a consolidation block, which is a block for consolidation, by moving the roller to be consolidated from a deployment block, which is a block where the roller to be consolidated is fixed when the medium is transported, to the consolidation block.

2. The inkjet printer according to claim 1, wherein in the main frame, a rail portion is provided in each of the blocks included in a moving range of the roller to be consolidated, and the first roller, the second roller, and the transport belt are configured to be consolidated in the consolidation block by moving the roller to be consolidated along the rail portion.

3. The inkjet printer according to claim 1, wherein the deployment block is provided with a first fixing portion for fixing the roller to be consolidated when the medium is transported, and the consolidation block is provided with a second fixing portion for fixing the roller to be consolidated when the first roller, the second roller, and the transport belt are consolidated in the consolidation block.

4. The inkjet printer according to claim 1, wherein a length of each of the plurality of blocks is configured to be not greater than 2352 mm in the transport direction.

5. The inkjet printer according to claim 1, wherein the plurality of blocks include a first block as the deployment block, a second block as the deployment block, and a third block as the consolidation block, the first block is positioned upstream of the third block in the transport direction when the first block is connected with the third block, the second block is positioned downstream of the third block in the transport direction when the second block is connected with the third block, the first roller is configured to be fixed in the first block, and the second roller is configured to be fixed in the second block when the medium is transported by the transport belt, and the first roller, the second roller, and the transport belt are configured to be consolidated in the third block, by moving the first roller from the first block to the third block and moving the second roller from the second block to the third block.

6. The ink jet printer according to claim 5, further comprising:

a medium support unit provided at an inside of the transport belt and in a region between the first roller and the second roller, and configured to support the medium via the transport belt, wherein the printing unit and the medium support unit are attached in the third block, and the medium support unit is configured to change a deployment range in the transport direction in the third block.

7. The ink jet printer according to claim 5, further comprising:

a pressing unit provided in the first block and configured to press the medium toward the transport belt; and a pressing unit-support unit provided at an inside of the transport belt and in a region between the first roller and the second roller, and configured to support the pressing unit via the transport belt, wherein the pressing unit-support unit is configured to move at least between the first block and the third block.

8. A method for separating an inkjet printer including a main frame, a first roller attached to the main frame, a second roller attached to the main frame, a transport belt wound around the first roller and the second roller and configured to transport the medium in a transport direction by rotating while supporting the medium, and a printing unit configured to perform printing on the medium supported on the transport belt, the main frame being configured of a plurality of blocks that are separably connected with one another in the transport direction, and the first roller and the second roller being fixed to the blocks that are different from each other when the medium is transported by the transport belt, the method comprising:

defining at least one of the first roller and the second roller as a roller to be consolidated, consolidating the first roller, the second roller, and the transport belt in a consolidation block, which is a block for consolidation, by moving the roller to be consolidated from a deployment block, which is a block where the roller to be consolidated is fixed when the medium is transported, to the consolidation block; and separating the main frame at least into a part including the consolidation block and a part including the deployment block.

* * * * *